United States Patent [19]

Taggart

[11] Patent Number: 4,829,313

[45] Date of Patent: May 9, 1989

[54] DRIVE SYSTEM AND FILAMENT FOR A TWISTABLE SEPTUM IN A FEEDHORN

[75] Inventor: Robert B. Taggart, Portola Valley, Calif.

[73] Assignee: Chaparral Communications, San Jose, Calif.

[21] Appl. No.: 851,163

[22] Filed: Apr. 14, 1986

Related U.S. Application Data

[63] Continuation of Ser. No. 672,094, Nov. 15, 1984, abandoned.

[51] Int. Cl.[4] ..... H01Q 3/12; H01Q 13/02

[52] U.S. Cl. ..... 343/756; 343/786; 343/766; 333/21 A

[58] Field of Search ..... 343/756, 786, 909, 761, 343/765, 766; 333/21 R, 21 A

[56] References Cited

U.S. PATENT DOCUMENTS

| | | | |
|---|---|---|---|
| 2,429,601 | 10/1947 | Biskeborn et al. | 343/756 |
| 2,541,030 | 2/1951 | Busignies | 343/766 |
| 2,628,278 | 2/1953 | Zaleski | 333/21 A |
| 2,987,722 | 6/1961 | Hefele et al. | 343/766 |
| 3,296,558 | 1/1967 | Bleackley | 333/21 R |
| 3,307,183 | 2/1967 | Adam | 343/756 |
| 4,503,379 | 3/1985 | Raiman | 343/909 |
| 4,504,836 | 3/1985 | Seavey | 343/786 |
| 4,574,258 | 3/1986 | Cloutier | 343/766 |

FOREIGN PATENT DOCUMENTS

| | | | |
|---|---|---|---|
| 804200 | 11/1958 | United Kingdom | 333/21 A |

*Primary Examiner*—William L. Sikes
*Assistant Examiner*—Michael C. Wimer
*Attorney, Agent, or Firm*—Schroeder, Davis & Orliss Inc.

[57] ABSTRACT

A drive system for a twistable septum in a feedhorn for use in satellite communications antenna systems. The drive system includes a flexible drive rod, coupled to a drive motor, which bends to accommodate off-center coupling with the septum drive wheel.

45 Claims, 5 Drawing Sheets

DRIVE SYSTEM AND FILAMENT FOR A TWISTABLE SEPTUM IN A FEEDHORN

CROSS REFERENCE TO RELATED APPLICATION

This is a continuation of application Ser. No. 672,094, filed Nov. 15, 1984, now abandoned.

BACKROUND OF THE INVENTION

In U.S. Pat. No. 4,503,379 entitled "Method and Apparatus for Rotation of Microwave Signal Polarization:", Ser. No. 484,255, filed Apr. 12, 1983, by Clifford Raiman, a rugged, mechanically simple septum for continuously variable rotation of microwave signal polarization in a feedhorn is described. That specification is hereby incorporated by reference as if fully set forth herein.

Of course, the septum could be rotated by a drive system comprising a combination of gears mounted on a support structure at the aperture of the feedhorn for coupling to the rotatable leg of the septum. In this configuration, the system can be powered by a remotely-controlled motor mounted at the rear of the feedhorn which is coupled to the gear train by a drive rod. However, gear trains are susceptible to freezing and icing in harsh weather, are subject to mechanical inaccuracies such as backlash and are more complex to assemble and expensive to manufacture.

The septum of the above-identified invention comprises a continuous, serpentine-shaped, electrically-conductive filament. The filament is formed into a series of interconnected legs for transverse orientation to wave propagation at the diameter of the circular waveguide of the feedhorn. The ends of one end leg of the filament are rigidly mounted to the inner wall of the circular waveguide at or near its output end.

The other end leg of the filament is coupled to a system for rotating that end leg around the longitudinal axis of the circular waveguide. As the driven leg rotates, the other legs follow such rotation in approximately equal, incremental angular rotations as determined by the leg-to-leg interconnections.

One scheme for rotating the end leg involves fastening the rotatable leg to an outer rotatable sleeve through slots in the wall of the circular wave guide. The sleeve may be manually rotated or rotated by a remotely controlled motor driving a V-belt in a V-groove formed in the outer surface of the sleeve.

The mechanics for rotating one end leg of the filament as described above is expensive to produce and adds unnecessary bulk and weight to the feedhorn on which it is mounted. In addition, since the configuration requires slots in the wall of the circular waveguide, the integrity of the device to withstand environmental extremes is comprised.

The septum described in the above identified invention is formed of half-hard brass rod or other material having similar resilient and shape-holding characteristics. Fabrication of the septum by bending a continuous wire to the required shape is difficult. As the wire is bent to form interconnected legs, the septum takes on an irregular, warped shape which produces unacceptable feedhorn performance.

SUMMARY OF THE INVENTION

One embodiment of a filament drive system constructed according to the principles of the present invention comprises a grooved, pulley-like drive wheel having chuck-like keepers for securing the rotatable leg of the filament thereto. In addition to a center hole for rotatable mounting, the septum drive wheel includes an off-center hole or recess disposed intermediate the center hole and the grooved rim. The off-center hole is configured to engage one end of a flexible drive rod.

The drive wheel is rotatably mounted on the inside surface of an aperture cover concentric with the longitudinal axis of the circular waveguide. The drive rod extends through the feedhorn along a path generally parallel to and nearly concentric with the longitudinal axis of the circular waveguide. The other end of the drive rod is coupled to the rotational output of a drive motor. Torsional rotation of the drive rod by the drive motor imparts rotation of the drive wheel in direct response thereto.

In another embodiment of the filament drive system of the present invention, the drive motor is mounted on the backside of the corrugated plate of the feedhorn. A rod, coupled to the rotational output of the motor through the corrugated plate, is rotatably coupled to the aperture cover. A second pulley wheel is mounted concentric with the axis of the rod at or near the inside surface of the aperture cover in the same plane as the septum drive wheel. The second pulley wheel is coupled to the septum drive wheel by a flexible belt having a suitable cross-sectional shape for circumferentially engaging the two wheels. As the motor turns the rod, both wheels rotate in direct relation which turns the rotatable leg of the filament.

Another embodiment of the flexible drive rod eliminates the need for a drive wheel. In this configuration, as a one-piece molded part, the drive rod includes the chuck-like keepers for securing to the rotatable leg of the filament and a pivot for rotatable mounting to support structure at the aperture concentric with the longitudinal axis of the circular wave guide.

A filament constructed according to the present invention comprises a thin sheet of stainless steel. The interconnected legs are formed by removing material by a well-known stamping process and conventional tooling methods. Notches are formed in the rotatable leg for secure engagement with the keepers on the drive wheel. The fixedly mounted leg of the filament includes an additional signal attenuator which forms part of the fixed mounting of the leg.

DESCRIPTION OF THE PREFERRED EMBODIMENT

Figure 1:
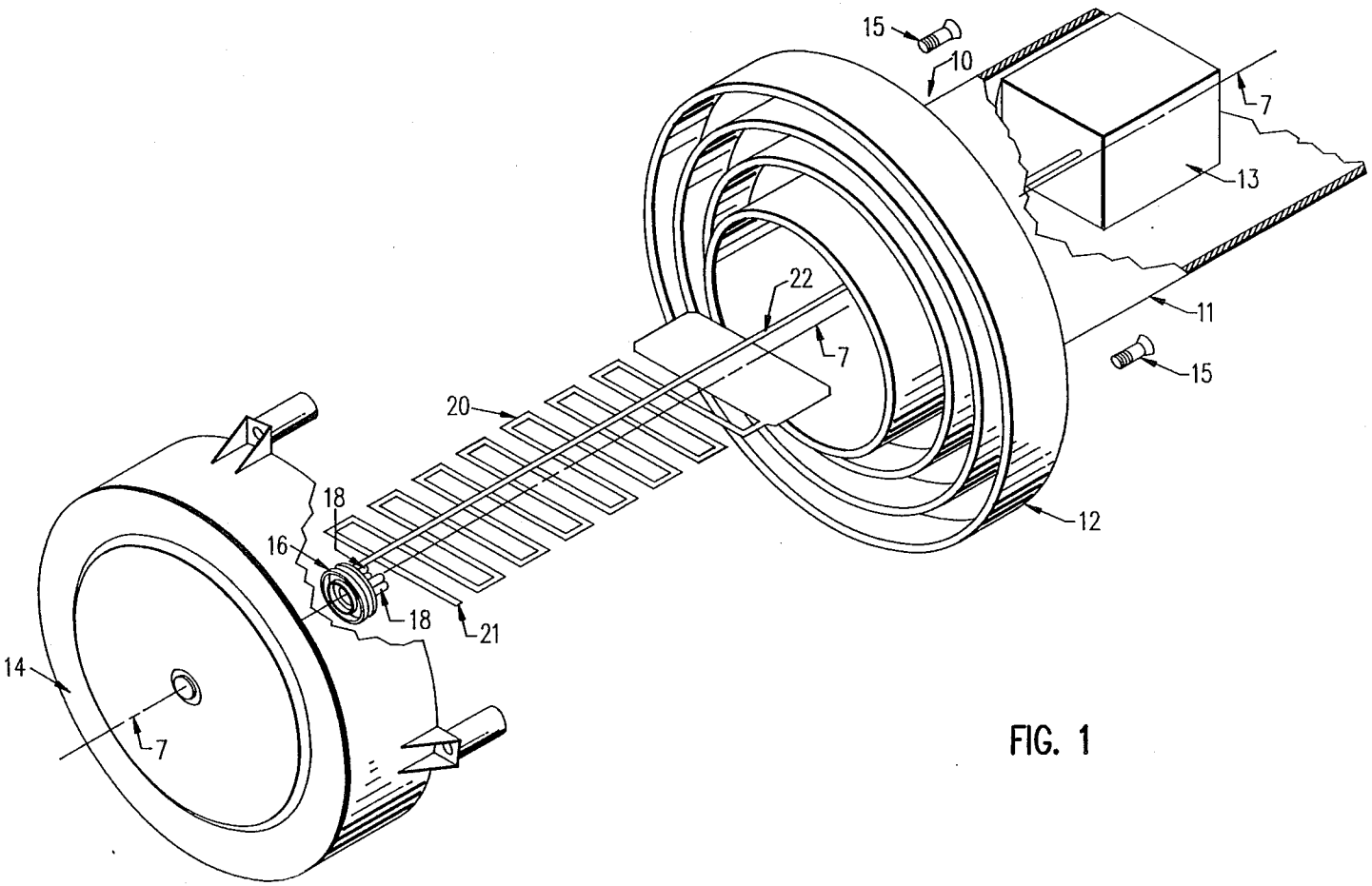
FIG. 1 is an exploded, perspective view of the septum drive system for a twistable septum in a feedhorn according to the principles of the present invention.
Figure 2:
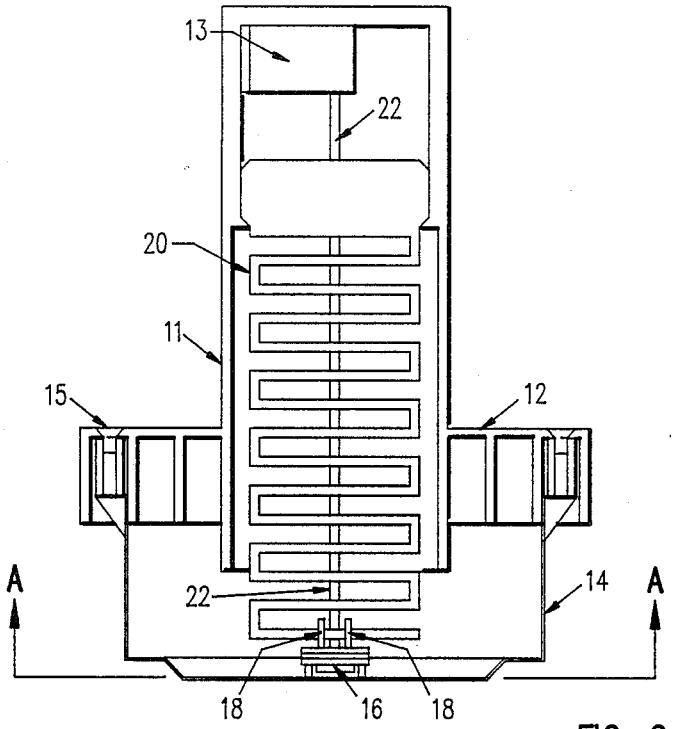
FIG. 2 is a cutaway side view of the septum drive system of FIG. 1.
Figure 3:
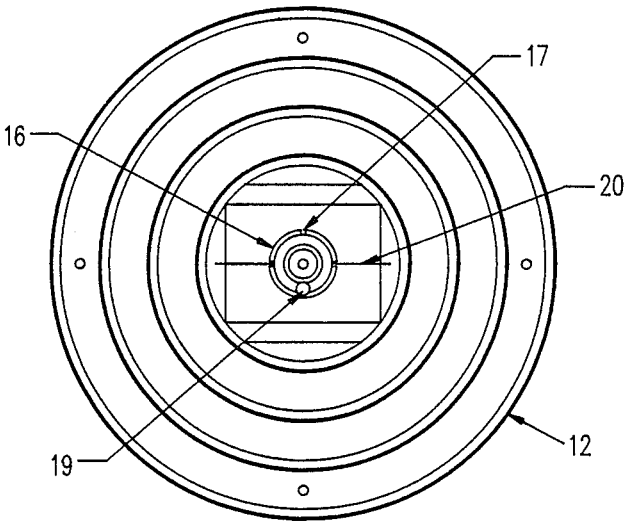
FIG. 3 is a front view at section A-A of the septum drive system of FIG. 2.

Refering first to FIGS. 1, 2, and 3, feedhorn 10, comprising circular waveguide 11 and corrugated plate 12, includes drive motor 13 mounted at or near the rear wall on the inside of circular waveguide 11. The rotational output of drive motor 13 is oriented parallel to and on the circular waveguide and behind the microwave signal output of the feedhorn.

Aperture cover 14 is mounted to corrugated plate 12 employing mounting screws 15. Septum drive wheel 16 is rotatably mounted on the inside surface of aperture cover 14 concentric with the longitudinal axis 7 of circular waveguide 11.

Septum 20 is disposed at the diameter of circular waveguide 11 to receive the desired microwave signal polarization. Rotatable leg 21 of septum 20 is fixedly coupled to septum drive wheel 16 by keepers 18 formed on one side of septum drive wheel 16. One end of drive rod 22 fixedly engages septum drive wheel 16 and the other end of drive rod 22 is coupled to the rotational output of drive motor 13. No other support for drive rod 22 is required.

Figure 4:
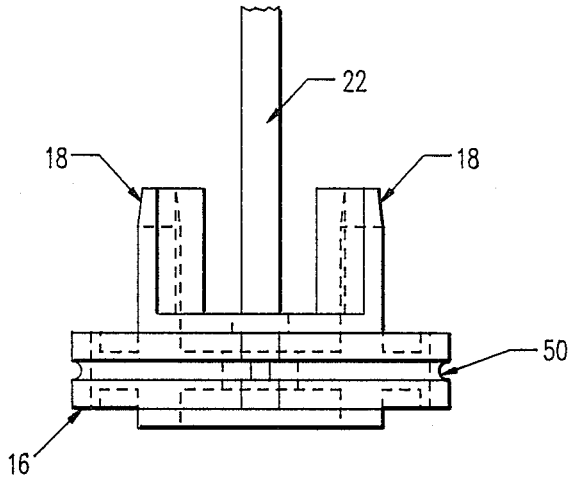
FIG. 4 is a side view of the septum drive wheel employed in the septum drive system of FIG. 3.
Figure 5:
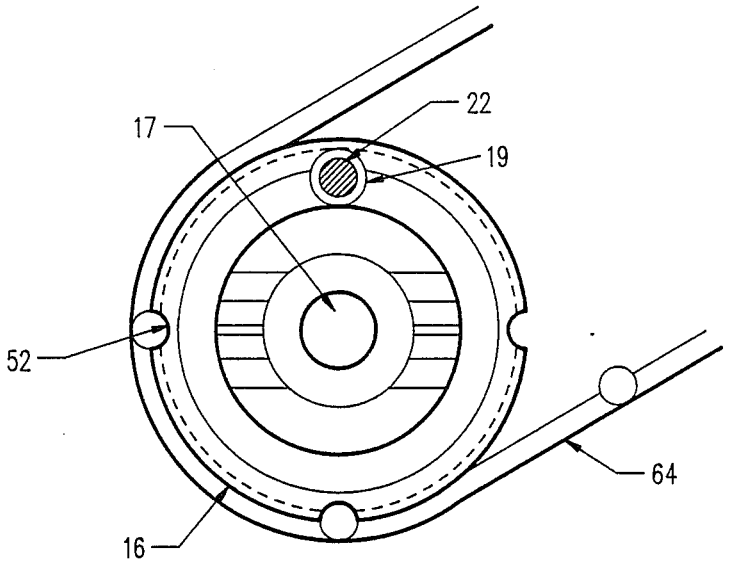
FIG. 5 is a front view of the septum drive wheel of FIG. 4.

Referring now to FIGS. 4 and 5 septum drive wheel 16 includes center mounting hole 17 coaxial with the center of the wheel, and off-center hole 19 for receiving one end of drive rod 22. The inside diameter of off-center hole 19 is slightly less than the outside diameter of drive rod 22, thus providing interference fit of drive rod 22 into off-center hole 19. The interference fit assures fixed relationship of septum drive wheel 16 with drive rod 22. The fixed relationship of the assembled parts may be enhanced by providing shoulders in the bore of off-center hole 19 or a polygonal bore for engaging the circular cross section of drive rod 22. Of course, off-center hole 19 need not be a hole if a recess will provide satisfactory fixed relationship of the drive wheel and drive rod assembly.

When drive motor 13 is energized, torsional rotation is applied to drive rod 22. Since drive rod 22 is fixedly coupled to septum drive wheel 16, it rotates in response to the torsional rotation applied to drive rod 22. Drive rod 22 is flexible along its longitudinal axis 7 so that, as it rotates, it bends to accommodate its off-center coupling with septum drive wheel 16. The distance between center mounting hole 17 and off-center hole 19 determines the radius around which drive rod 22 must flexibly rotate.

Keepers 18 are formed on one side of septum drive wheel 16 for receiving and coupling to rotatable end leg 21 of filament 20 at the diameter of septum drive wheel 16. Keepers 18 each comprise pairs of compression members between which the thinnest dimension of end leg 21 fits. Groove 50 is formed in the rim of drive wheel 16. As septum drive wheel 16 rotates, rotatable end leg 21 is rotated and the remaining interconnected legs of septum 20 incrementally rotate in the same direction. Drive wheel 16 may include noteches as shown in FIG. 5 for use in another embodiment of the present invention described later in this specification.

The configuration of feedhorn 10 is the same as that described for a feedhorn in the specification mentioned elsewhere and incorporated by reference herein. Septum drive motor 13 can be the same as, or similar to, servo motors used in remotely controlled model aircraft for control surface movement.

Figure 6:
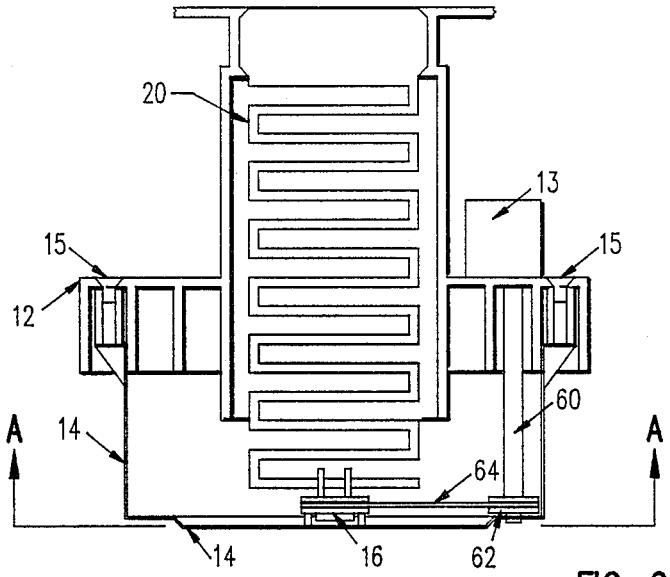
FIG. 6 is a cutaway side view of another embodiment of the septum drive system of FIG. 1.

In another embodiment of the present invention, drive motor 13 is mounted on the backside of corrugated plate 12 as shown in FIG. 6. Drive rod 60 is coupled at one end to the rotational output of drive motor 13 through corrugaged plate 12, and rotatably mounted at the other end to aperture cover 14. Pulley wheel 62 is coaxially and fixedly mounted at or near the end of drive rod 60, nearest and inside aperture cover 14.

Figure 7:
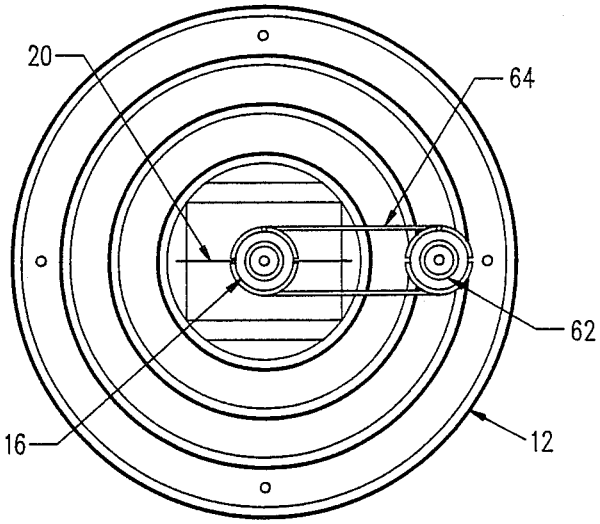
FIG. 7 is a front view of the twistable septum system of FIG. 6.

Pulley wheel 62 is coupled to drive wheel 16 by drive belt 64 as shown in FIG. 7. Drive belt 64 is formed with cross sectional shape suitable for engaging groove 50 of septum drive wheel 16 and includes protrusions for engaging notches 52. The dimensions and the configuration of the groove and notches in the rim of pulley wheel 62 are identical to the dimensions and the configuration of the groove and notches in the rim of septum drive wheel 16. As drive motor 13 applies torsional rotation to drive rod 60, septum drive wheel 16 rotates in response to the corresponding rotation of pulley wheel 62 and translation of drive belt 64.

Figure 9:
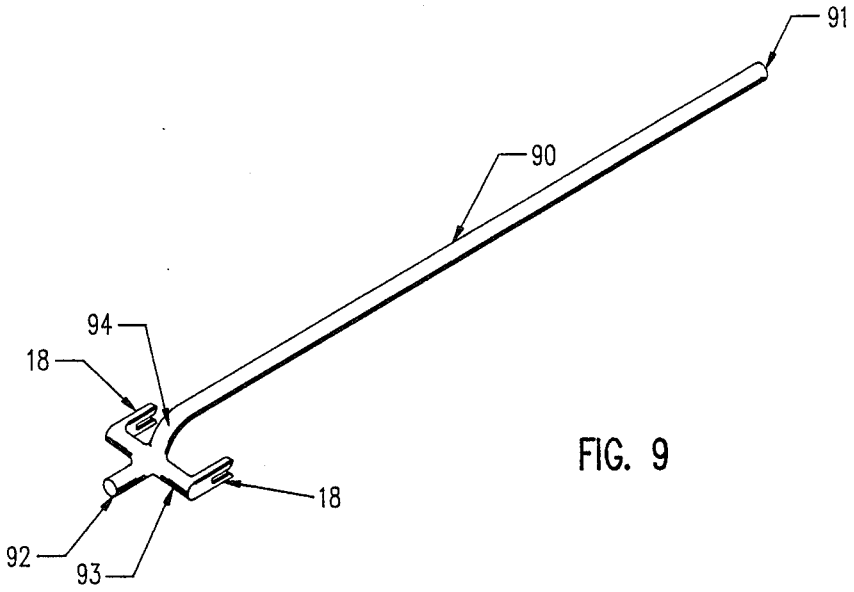
FIG. 9 is a perspective view of another embodiment of the flexible drive rod of the septum drive system of FIG. 1.

Flexible drive rod 90 shown in FIG. 9 eliminates the need for septum drive wheel 16 while still providing axial rotation of the septum. Pivot 92 is rotatably supported by any support structure such as aperture cover 14 at the aperture concentric with the longitudinal axis of the circular waveguide of the feedhorn. Keepers 18, mounted to support bar 93, couple to the rotatable leg 21. As torsional rotation is applied at drive motor end 91, flexible drive rod 90 rotates around pivot 92 which in turn rotates support bar 93 and rotatable end leg 21 around the longitudinal axis 7 of the circular waveguide of the feedhorn.

The longitudinal axis 7 of drive rod 90 and pivot 92 are parallel. They are coupled together by coupling member 94 which, though not required, may be perpendicular to both. Since the longitudinal axis of drive rod 90 is typically fixed at motor end 91, the length of coupling member 94 determines the radius around which drive rod 90 must flexibly rotate.

Drive rod 90 may be a one-piece, molded part including support bar 93 and keepers 18. It should be constructed of material selected for minimal effect on the electrical performance of the feedhorn.

Figure 8:
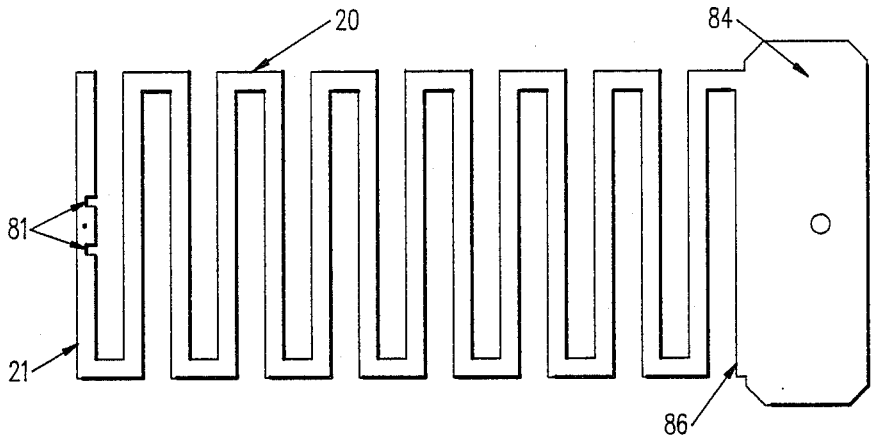
FIG. 8 is a side view of a septum constructed according to the principles of the present invention.

Referring now to FIG. 8, septum 20 is constructed of 0.015 inch thick, type 304 stainless steel flat sheet. The interconnected legs are formed by removing the interstitial material from between the legs by conventional stamping processes employing well-known tooling techniques. Notches 81 are formed in rotatable leg 21 to assure reliable, centered coupling with keepers 18 of septums drive wheel 16. Attenuator 84, an extension of end leg 86, is rigidly mounted to the inner wall at or near the output end of feedhorn 10 to further attenuate any unwanted polarization transmitted through the feedhorn. Thus, attenuator 84 facilitates mounting of end leg 21 to the wall of circular waveguide 11.

Aperture cover 14, septum drive wheel 16, drive rod 22, drive rod 60, pulley wheel 62 are all molded of plastic material such as polyurethane. Any other, equally lightweight material, having similar electrical characteristics for minimal effect on the electrical performances of the feedhorn, may be used. The material must also be capable of withstanding the environmental extremes of temperature, precipitation and contamination to which feedhorns, used with reflector antennas in earth stations for satellite communications, are exposed.

I claim:

1. A drive system including a twistable septum disposed along the diameter and along the longitudinal axis of a feedhorn having a circular waveguide, an aperture and an output, said septum having one end near the aperture of the feedhorn and the other end fixedly mounted with respect to the circular waveguide near the output of the feedhorn, said system further comprising:

an aperture cover mounted over the aperture of the feedhorn concentric with the longitudinal axis of the circular waveguide thereof;

a drive wheel, having a rim, a center and first coupling means disposed intermediate the rim and the center, concentrically and rotatably mounted on the inside surface of the aperture cover, said drive wheel also having second coupling means for fixedly coupling to said one end of the septum;

a drive motor having a rotational output oriented parallel to and near the longitudinal axis of the circular wave guide; and a flexible drive rod, coupled to the rotational output of the drive motor and to the first coupling means on the drive wheel, for rotating the drive wheel in response to torsional rotation applied by the drive motor.

2. Apparatus as in claim 1 wherein the twistable septum comprises interconnected leg segments constructed of flat sheet, conductive material, said leg segments having a thickness dimension substantially equal to the thickness dimension of the sheet material.

3. Apparatus including a twistable septum disposed along the diameter and along the longitudinal axis of a feedhorn, said feedhorn having a circular waveguide, an aperture and an output end, said septum having a rotatable end near the aperture of the feedhorn and the other end fixedly mounted with respect to the circular waveguide near the output end of the feedhorn, said apparatus further comprising:

drive means for producing rotational motion;

coupling means having a longitudinal aixs, said coupling means having a first end coupled to said drive means and a second end coupled to said rotatable end of the septum for applying rotational motion thereto;

said coupling means including means for rotatably mounting said second end of said coupling means near the aperture of said feedhorn.

4. Apparatus as in claim 3 wherein said mounting means includes engaging means fixedly mounted near the aperture of the feedhorn for rotatably engaging said second end of the coupling means substantially on the longitudinal axis of the circular waveguide.

5. Apparatus as in claim 4 wherein the second end of the coupling means includes pivot means for rotatably engaging the engaging means and for fixedly coupling to said rotatable end of the septum.

6. Apparatus as in claim 5 wherein said engaging means includes an aperture cover fixedly mounted to said feedhorn.

7. Apparatus as in claim 5 wherein:

the coupling means further includes a drive rod for coupling the drive means to said rotatable end of the septum; and the pivot means includes compression fit keepers for coupling said rotatable end of the septum to the pivot means.

8. Apparatus as in claim 4 wherein the second end of the coupling means includes a drive wheel for rotatably engaging the engaging means and having a center, a rim and first coupling means disposed intermediate the center and the rim for fixedly mounting on the second end of the coupling means, and having second coupling means for fixedly coupling to said rotatable end of the septum.

9. Apparatus as in claim 8 wherein the engaging means includes an aperture cover.

10. Apparatus as in claim 8 wherein the coupling means further includes a drive rod for coupling the drive means to said rotatable end of the septum.

11. Apparatus as in claim 10 wherein:

the first coupling means is a hole for providing interference fit with the drive rod; and the second coupling means are compression fit keepers.

12. Apparatus as in claim 3 wherein the twistable septum comprises continuously interconnected leg segments constructed of flat sheet, conductive material, said leg segments having a thickness dimension substantially equal to the thickness dimension of the sheet material.

13. Apparatus as in claim 3 wherein the drive means is a motor having its rotational output disposed substantially parallel to and near the longitudinal axis of the circular waveguide.

14. Apparatus as in claim 13 wherein the rotational output of the motor is disposed near the output end of the feedhorn.

15. Apparatus including a twistable septum disposed along the diameter and along the longitudinal axis of a feedhorn having a circular waveguide, an aperture and an output, said septum having one end near the aperture of the feedhorn and the other end fixedly mounted with respect to the circular waveguide near the output of the feedhorn, said apparatus further comprising:

engaging means mounted near the aperture of the feedhorn concentric with the circular wave guide thereof;

a drive wheel concentrically and rotatably mounted on the engaging means, and fixedly coupled to said one end of the septum;

a drive motor having a rotational output oriented parallel to the longitudinal axis, and near the aperture, of the circular waveguide; and belt means, coupled to the rotational output of the drive motor and to the drive wheel, for rotating the drive wheel in response to said rotational output of the drive motor.

16. Apparatus as in claim 15 wherein the engaging means includes an aperture cover.

17. Apparatus as in claim 15 wherein the twistable septum comprises interconnected leg segments constructed of flat sheet, conductive material, said leg segments having a thickness dimension substantially equal to the thickness dimension of the sheet material.

18. Apparatus as in claim 15 wherein:

the belt means includes a plurality of transverse protrusions; and the drive wheel includes notches formed in the rim thereof for engaging the protrusions of the belt means as said drive wheel rotates.

19. Apparatus as in claim 18 wherein the drive motor further includes a pulley wheel, having notches formed in the rim thereof for engaging the protrusions of the belt means, mounted on the rotational output thereof.

20. Apparatus including a twistable septum mounted within a signal receiver having an aperture, one end of said septum being rotatable about a longitudinal axis thereof relative to the other end, said apparatus further comprising:

a drive shaft having one end pivotally mounted on pivot means disposed substantially at the aperture of said signal receiver;

means for rotating said drive shaft; and means mounted on said pivot means for interconnecting said rotatable end of the septum to the drive shaft near the pivotally mounted end thereof, whereby said septum may be caused to twist within said signal receiver.

21. Apparatus according to claim 20 wherein:

the signal receiver includes a longitudinal axis; and the longitudinal axis of the twistable septum extends along the longitudinal axis of the signal receiver, said other end being fixedly mounted near an output of the signal receiver.

22. Apparatus according to claim 20 in which the twistable septum comprises a meandering strip of flat conductive material.

23. Apparatus according to claim 22 in which the twistable septum comprises a plurality of straight interconnected leg segments extending side-by-side in substantially the same plane.

24. Apparatus according to claim 23 in which the twistable septum further comprises means for attenuating undesirable signals, said attenuating means being fixedly mounted with respect to the signal receiver near an output end of the signal receiver.

25. Apparatus according to claim 24 in which said attenuating means comprises a flat sheet of conductive material coplanar with said leg segments and of substantially the same thickness.

26. Apparatus according to claim 20 in which said rotating means comprises a drive motor having a rotational output disposed substantially parallel to and near a longitudinal axis of said signal receiver.

27. Apparatus according to claim 26 wherein the drive motor is positioned near an output end of the signal receiver.

28. Apparatus according to claim 20 in which said drive shaft is a flexible rod, said rod being substantially inflexible torsionally and generally flexible along the longitudinal axis thereof.

29. Apparatus according to claim 20, in which said interconnecting means comprises a drive wheel coupled to the signal receiver, said drive wheel being engaged by said one end of the said drive shaft and having coupling means for engaging said one end of the septum.

30. Apparatus according to claim 29 wherein:

said drive wheel is formed with a recess situated off center and adapted to provide interference fit with said one end of said drive shaft; and said coupling means comprises a pair of compression fit keepers adapted to retain a portion of the rotatable end of the septum.

31. Apparatus according to claim 29 further including an aperture cover mounted on the signal receiver adjacent the rotatable end of the septum, said drive wheel being rotatably mounted on said aperture cover.

32. Apparatus according to claim 20, in which said interconnecting means comprises:

a drivable member fixedly coupled to the rotatable end of the septum; and belt means interconnecting said drive shaft and said member for rotating said member in response to rotation of said drive shaft.

33. Apparatus according to claim 32 wherein:

one of said belt means and said drivable member is provided with a plurality of transverse protrusions; and the other of said belt means and said drivable member includes a plurality of notches for receiving said protrusions thereby to cause said drivable member to rotate when said drive shaft rotates.

34. Apparatus according to claim 33 in which said belt means comprises an endless belt provided with said protrusions and said drivable member comprises a drive wheel having said notches formed in the rim thereof.

35. Apparatus according to claim 34 wherein said interconnecting means further comprises a pulley wheel engaged by said drive shaft and by said endless belt, said pulley wheel having notches formed in the rim thereof for receiving the protrusions of said belt thereby to cause drive wheel to rotate with said drive shaft.

36. Apparatus according to claim 20 in which said interconnecting means comprises means carried by said drive shaft at said one end thereof for gripping said one end of the septum, thereby to cause the septum to twist when said shaft is rotated.

37. Apparatus according to claim 36 in which said one end of said drive shaft is adapted to extend non-parallel to the remainder of said shaft and terminates in a support member, said gripping means being carried by said support member.

38. Apparatus according to claim 37 in which said gripping means comprises compression fit keepers.

39. Apparatus according to claim 37 in which said non-parallel end of said drive shaft is provided with a protrusion pivotally journalled in an end portion of the signal receiver.

40. Apparatus according to claim 39 in which said protrusion extends substantially parallel to the longitudinal axis of said drive shaft.

41. Apparatus according to claim 40 where in said end portion comprises an aperture cover.

42. Apparatus including a twistable septum mounted in a signal receiver having an aperture, one end of said septum being rotatable about a longitudinal axis thereof relative to the other end, said apparatus further comprising:

a rotatable drive shaft having a first end and a second end;

a drive motor coupled to said first end of the drive shaft for rotating said drive shaft;

pivot means for engaging the rotatable end of said septum pivotally mounted substantially at said aperture;

a drive wheel concentrically and rotatably mounted on said pivot means and coupled to the rotatable end of said septum, said drive wheel engaging the second end of said drive shaft off-center near the outer perimeter of said drive wheel, said second end of said drive shaft engaged off-axially with respect to said longitudinal axis; and coupling means coupling said drive wheel to said rotatable end of said septum coaxially with said longitudinal axis.

43. Apparatus according to claim 42 wherein said drive wheel includes a hole disposed off-center of said drive wheel for engaging said second end of said drive shaft off-axially with respect to said longitudinal axis.

44. Apparatus as in claim 43 wherein said coupling means includes compression fit keepers for fixedly coupling the rotatable end of said septum to said drive wheel.

45. Apparatus as in claim 42 wherein said pivot means further includes an aperture cover.

* * * * *